United States Patent [19]

Enderlin

[11] Patent Number: 5,024,390

[45] Date of Patent: Jun. 18, 1991

[54] APPARATUS WITH ENDLESS SCREWS FOR FORMING FLAT LOOPS OF TEXTILE YARN

[75] Inventor: Robert Enderlin, Morschwiller-Le-Bas, France

[73] Assignee: Superba S.A., Mulhouse, France

[21] Appl. No.: 633,158

[22] Filed: Dec. 21, 1990

Related U.S. Application Data

[63] Continuation of Ser. No. 859,659, May 5, 1986, abandoned.

[30] Foreign Application Priority Data

May 7, 1985 [FR] France ..... 85-07062

[51] Int. Cl.[5] ..... B65H 51/20; D02G 1/20

[52] U.S. Cl. ..... 242/47; 242/47.12; 28/289

[58] Field of Search ..... 28/101, 281, 289; 226/118; 242/47.08, 47.09, 47.1, 47.11; 19/299

[56] References Cited

U.S. PATENT DOCUMENTS

| | | | |
|---|---|---|---|
| 2,958,920 | 11/1960 | Erb | 28/289 X |
| 3,774,384 | 11/1973 | Richter | 28/281 X |
| 4,277,867 | 7/1981 | Lucke | 28/281 X |
| 4,383,655 | 5/1983 | Ahrendt et al. | 242/47.08 X |

FOREIGN PATENT DOCUMENTS

| | | | |
|---|---|---|---|
| 202426 | 7/1956 | Australia | 28/289 |
| 1909738 | 9/1969 | Fed. Rep. of Germany | 28/289 |

*Primary Examiner*—Werner H. Schroeder
*Assistant Examiner*—John J. Calvert
*Attorney, Agent, or Firm*—Bell, Seltzer, Park & Gibson

[57] ABSTRACT

Apparatus with endless screws for forming flat loops of textile yarn.

The invention relates to an apparatus having endless screws for forming flat loops of yarn and depositing them on a conveyor belt.

The apparatus comprises two endless screws (10 and 11) with parallel axes which are rotatingly driven in opposite directions, two support and guide members (12 and 13) disposed laterally with respect to the screws and two deviating rods (26, 27) equidistant from these screws. These members and these rods serve to carry the loops of yarn, to bring them forward to the vicinity of a conveyor belt (24) and to deposit them on its surface after having previously turned them over.

This device is useful to allow the loops of yarn to be immediately turned over without necessitating an intermediate belt to turn them over.

16 Claims, 1 Drawing Sheet

APPARATUS WITH ENDLESS SCREWS FOR FORMING FLAT LOOPS OF TEXTILE YARN

This is a continuation of copending application Ser. No. 06/859,659 filed on May 5, 1986, abandoned.

FIELD OF THE INVENTION

The present invention relates to an apparatus with endless screws for forming flat loops of textile yarn and depositing them on a conveyor belt.

BACKGROUND OF THE INVENTION

Various endless screw systems are known for forming loops of textile yarn and depositing them on a conveyor belt. One of these systems is illustrated by the British patent application published under No. 2 024 271. A rotating arm coils the yarn around rotatingly driven screws, which results in successively forming loops in the vicinity of the head end of the screw, these loops being displaced axially along the screws due to the rotation of the latter. Given that the yarn loops are directly carried by the screws, friction due to rotation of the latter produces tension in the yarn strands. The yarn loops are moreover deposited on the conveyor belt with the same orientation as that with which they are formed on the screws. To permit easy recovery, that is to say in order not to be obliged to pull the yarn underneath the loops subsequently deposited, whereby the yarn may become entangled which is liable to slow down or even stop the installation, one is generally obliged to carry out a turnover operation which consists in turning the yarn loops around by 180° while they are transported on the conveyor belt, for example, by means of a second, so-called turnover belt.

Known depositing systems generally form substantially round loops which are superposed with a slight axial shift. The formation of round loops presents various drawbacks. One such drawback is that the round loop does not allow a uniform density of the deposited yarn to be achieved, which results in a lack of homogeneous yarn retraction during thermal treatment, in particular of synthetic fibers. The round loops which overlap on the conveyor belt present a much higher overall density of material on the sides than at the center. During the drying, thermosetting or expressing operation, the latter being effected by rubberized rolls in opposition, the effect of treatment is very different between the sides and the center of the band of yarn loops deposited on the conveyor.

At the moment of retraction of the yarn or synthetic thread, the geometry of the deposition in the form of round loops does not permit uniform retraction because of friction acting differently on the superposed yarn portions depending on whether these yarn portions form with each other very narrow or very wide angles. The consequences may be particularly inconvenient for certain realizations especially for the fabrication of yarns for tufted carpets cut at very small height which are piece-dyed after tufting.

These findings speak in favor of abandoning the deposition of round loops and the adoption of oval or flat loops.

SUMMARY OF THE INVENTION

The object of the present invention is to overcome all of the previously mentioned drawbacks by allowing flat loops to be deposited on the belt, which are moreover turned over in such a manner that they are presented at the extremity of the belt in the most favorable position for ensuring rapid and easy recovery without risk of getting entangled.

This is achieved by the apparatus according to the invention, which is characterized in that it comprises at least two members for supporting and guiding the yarn loops, disposed on either side of the endless screws.

According to a preferred embodiment, the apparatus comprises two endless screws which are disposed parallel to each other and driven in opposite directions.

It also comprises two deviating rods ensuring the formation of an oval coil at depostion.

Two lateral guides are preferably designed to provide for turning the yarn loops over between the tail end of the endless screws and the zone of deposition on the surface of the conveyor belt and to allow the initially oval loop to achieve and elongated, flat shape.

These lateral guides preferably each comprise a tail end part disposed substantially parallel to the surface of the conveyor belt, at a distance from this belt at most equal to the thickness of the yarn.

To facilitate turning the yarn loops over, the surface of the conveyor belt is preferably arranged to act by friction for driving the yarn, and it is preferably displaced at a speed greater than the displacement of the yarn loops on the lateral guides.

According to a particularly advantageous embodiment, the screws are disposed substantially perpendicularly with respect to the conveyor belt.

In this embodiment, the lateral guides are elbow shaped and have one branch directed parallel to the axis of the screws and the other branch parallel to the surface of the belt.

The branch perpendicular to the belt surface comprises four distinct sections,

- a first head end section substantially parallel to the axis of the screws and parallel to the similar section of the other branch,
- a second, inclined section convergent with the similar section of the other branch,
- a third, inclined section divergent with respect to the similar section of the other branch,
- a fourth section substantially parallel to the screw axis.

The two deviating rods are situated in a plane parallel to the axis of the screws, equidistant from these screws, this plane being perpendicular to the plane defined by the branches of the lateral guides which are perpendicular to the belt surface. They are curved shape and are convergent towards the belt.

According to another embodiment, the endless screws are disposed in parallel with respect to the conveyor belt surface and the lateral guides comprise at least one tail section which form an angle less than 90° with this surface.

The present invention may be better understood with reference to the description of an embodiment and the accompanying drawings.

Figure 4:
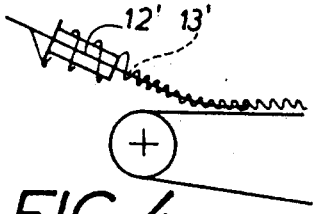
Figure 5:
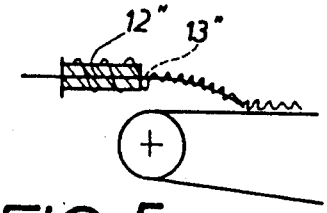

FIGS. 4 and 5 schematically illustrate two particular arrangements of the endless screws and the corresponding embodiments of the guide members.

DESCRIPTION OF BEST MODE

Figure 3:
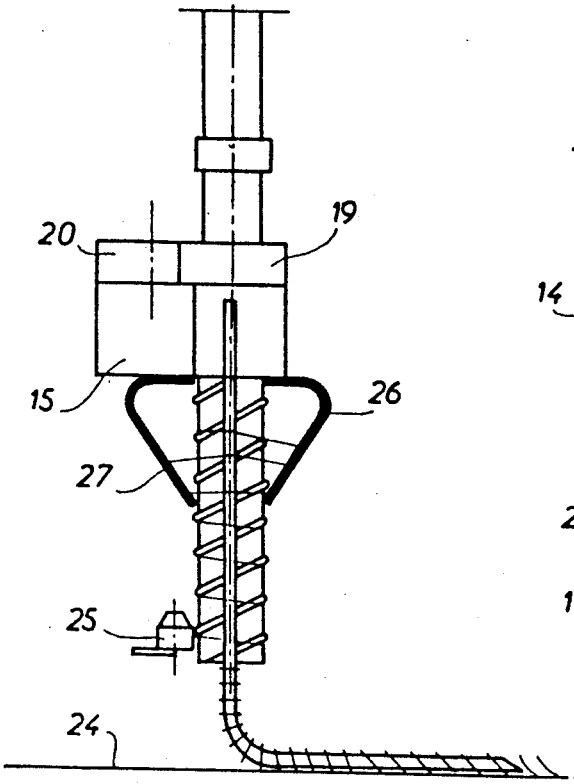
FIG. 3 represents a side view of the same apparatus.
Figure 1:
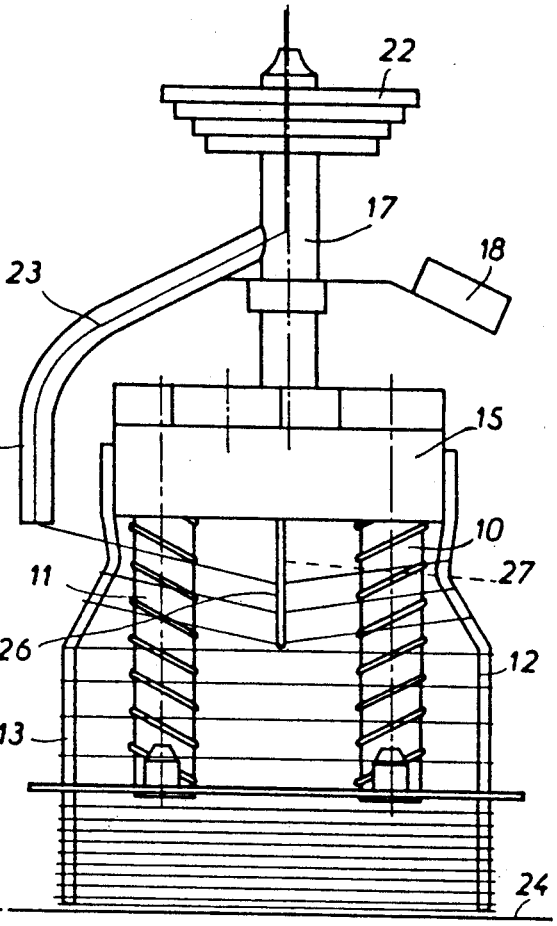
FIG. 1 represents a front view of a preferred embodiment of the apparatus according to the invention.
Figure 2:
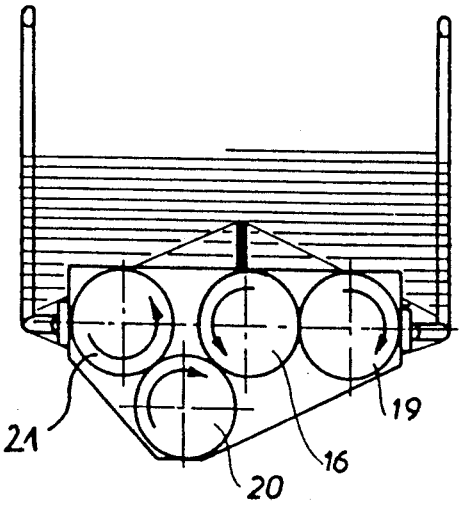
FIG. 2 represents a top view of the apparatus illustrated in FIG. 1.

With reference to the figures and in particular to FIGS. 1 to 3, the apparatus essentially comprises two endless screws 10 and 11 parallel to each other, two support and guide members 12 and 13 disposed on either side of the endless screws 10 and 11, two deviating rods 26 and 27 and a rotating arm 14 arranged to rotate around the screws, the support and guide members and the deviating rods to coil the yarn around these elements and to thus form yarn loops. The endless screws, the support and guide members and the deviating rods are carried by a base 15 on which the mechanism for driving the screws 10 and 11 is mounted. This mechanism comprises a principal driving pinion 16 fixed to the extremity of a driving shaft 17 which likewise carries the rotating arm or flier 14 and a counterweight 18 for balancing the weight of this flier.

This principal driving pinion 16 meshes with a driving pinion 19 connected to the endless screw 10 and with an intermediate pinion 20 which meshes with a driving pinion 21 connected to the other endless screw 11. The intermediate pinion 20 allows the direction of rotation of the screw 11 to be reversed with respect to that of the screw 10. A driving pulley 22 is mounted on the driving shaft 17 to transmit to this shaft the torque of a motor (not shown). The shaft 17 comprises a central bore which communicates with the flier 14 to allow the passage of a yarn 23.

The support and guide members are disposed and designed in such a manner that the yarn loops are essentially carried by them and only undergo relatively slight friction with the endless screws. The helical ribs of the endless screws serve to push the yarn loops from the head end of the screws where the loops are formed towards the tail end, where these loops are discharged to be completely taken up by the support and guide members 12 and 13.

In the example illustrated in FIGS. 1 to 3, the support and guide members have the form of two elbowed arms. The plane of one of the elbow branches is parallel to the axis of the screws, the latter being perpendicular with respect to the receiving surface of the conveyor belt 24, while the other branch is parallel to this surface. The distance between the parallel branch and the surface 24 is less than or at most equal to the yarn diameter, and the surface 24 has a sufficiently high coefficient of friction for contact between this surface and the yarn loops to produce a frictional force tending to drive the yarn loops. The speed of the conveyor belt is greater than the speed of the loops pushed by each other on the support and guide members. They are thereby inclined progressively in such a manner that, in the same vertical plane, the lower part of the loops is further downstream towards the tail end than the upper part of these loops, deposited on the conveyor belt. The orientation of the resulting loops is ideal to promote effective, rapid reeling without risk.

The device may be stopped by locking shoes 25 placed respectively behind the screws 10 and 11 and designed to prevent rotation of these screws. The upper part of these shoes has a conical form to facilitate engagement of the yarn coil between the shoe and the screw.

FIG. 4 illustrates a variant in which the two branches of the support and guide members 12', 13' form a very wide angle due to the inclination of the endless screws with respect to the conveyor belt.

FIG. 5 illustrates another embodiment which shows the form that the support and guide members 12'', 13'' may have when the endless screw is placed substantially parallel to the conveyor belt surface.

The described apparatus presents numerous advantages. Due in particular to the fact that the rib or helical thread of the screws only serves to drive the yarn whose loops are essentially retained and carried by the support and guide members, and not by the screw itself, minimum friction acts on the lateral portions of the yarn loops.

Another advantage of the apparatus according to the invention resides in the fact that the position of the deviating rods 26 and 27 and their curved configuration as well as the converging sections of the lateral guides permit the initial formation of a coil of oval shape, the diverging sections of these guides then permitting this coil to achieve an elongated and flat shape.

An appropriate combination of the angles of the deviating rods and the angles of the inclined sections of the lateral guides thus makes it possible for the coil to change its shape without changing its circumference.

The change in form of the coil prevents the shocks which would occur if flat coils were deposited straight away.

The form of the support and guide members is also designed to facilitate deposition of the loops on the conveyor belt. The extremities of these members are preferably slightly convergent so that they may be more readily released.

The surface finish of the guide members may be provided so that the loops may readily slide on the first part of the path followed by these loops and that they undergo a certain braking action promoting their inversion in the zone near the conveyor belt.

According to a preferred embodiment, the rotating arm or flier 14 may comprise at its extremity a rotating articulated member whereby to facilitate deposition of the yarn by orienting it in the direction thereof.

The rotating member will thus effectively decrease friction between the yarn and the end of the flier and thereby decrease the tension of the yarn when it is deposited.

The present invention is not limited to the described embodiments but may undergo different modifications and may thus present diverse variants which will be obvious to a person skilled in the art.

I claim:

1. Apparatus for forming flat loops of textile yarn and depositing them on a moving conveyor belt, comprising a conveyor belt, at least two endless screws, means for driving said endless screws, at least two members for supporting and guiding yarn loops, said support and guide members being disposed on either side of said endless screws outwardly thereof, two deviating rods, said deviating rods being disposed in a plane parallel to the axes of said endless screws and equidistant therefrom, said plane being perpendicular to a plane defined by said support and guide members and perpendicular to a surface of said conveyor belt, a driven rotating arm arranged to rotate and coil yarn around said endless screws, said support and guide members and said deviating rods, said support and guide members being configured to permit inverting the yarn loops between the ends of said endless screws and a zone of deposition of said loops on said conveyor belt surface, and means for inverting the yarn loops comprising a surface on said conveyor belt adapted to provide friction for driving the yarn and means for displacing said conveyor belt surface at a speed greater than the speed of displacement of said yarn loops on said support and guide members.

2. Apparatus according to claim 1, wherein said support and guide members each have an end section disposed substantially parallel to said conveyor belt surface at a distance from said surface which is at most equal to the yarn thickness.

3. Apparatus according to claim 2, wherein said endless screws are disposed substantially perpendicularly with respect to said conveyor belt surface, and said support and guide members are elbow-shaped so as to have one branch in a direction parallel to the axis of said screws and another branch parallel to said conveyor belt.

4. Apparatus according to claim 2, wherein said end sections of said support and guide members are slightly convergent.

5. Apparatus according to claim 2, wherein said support and guide members are provided adjacent the ends thereof in the zone near said conveyor belt with a coefficient of friction greater than that of the remainder of said members.

6. Apparatus according to claim 1, wherein said endless screws are disposed substantially perpendicularly with respect to said conveyor belt surface, and said support and guide members are elbow-shaped so as to have one branch in a direction parallel to the axis of said screws and another branch parallel to said conveyor belt.

7. Apparatus according to claim 6, wherein said branch perpendicular to said conveyor belt surface comprises four distinct sections.

8. Apparatus according to claim 7, wherein two of said distinct sections are convergent and divergent, and the other two sections are parallel to the axis of said screws.

9. An apparatus for forming flat loops of textile yarn and for delivering the yarn in inverted loop form for further processing, comprising:

a driven conveyor belt;

at least two driven endless screws positioned in substantially parallel relation to one another;

at least two support and guide members disposed on either side of said screws outwardly thereof;

means for preventing shocks in the yarn during formation of loops around said screws and said support and guide members;

a driven rotating arm arranged to rotate and coil yarn to form loops of yarn around said endless screws, said support and guide members and said means for preventing shocks in the yarn, said support and guide members being configured to permit inverting the yarn loops between the ends of said endless screws and a zone of deposition of said loops on said conveyor belt surface; and means for inverting the yarn loops comprising a surface on said conveyor belt adapted to provide friction for driving the yarn and means for displacing said conveyor belt surface at a speed greater than the speed of displacement of said yarn loops on said support and guide members.

10. Apparatus according to claim 9 wherein said support and guide members and said shock preventing means are configured to permit initial formation of a generally oval loop of yarn and thereafter permitting the loop to achieve an elongated and flat shape without changing the circumference of the loop.

11. Apparatus according to claim 9 wherein said means for preventing shocks in the yarn comprise at least two deviating rods.

12. Apparatus according to claim 9 wherein said endless screws are disposed substantially perpendicularly with respect to said conveyor belt surface, and said support and guide members are elbow-shaped so as to have one branch disposed in a direction generally parallel to the axes of said screws and another branch generally parallel to the zone of deposition of said conveyor belt.

13. Apparatus according to claim 12 wherein said branch disposed generally parallel to the axes of said screws comprises four distinct sections.

14. Apparatus according to claim 13 wherein two of said distinct sections are convergent and divergent, and the other two sections are parallel to the axes of said screws.

15. Apparatus according to claim 12 wherein said branches of said support and guide members that are disposed in a direction generally parallel to the zone of deposition of said conveyor belt are slightly convergent.

16. Apparatus according to claim 15 wherein said branches disposed generally parallel to said zone of deposition are provided with a coefficient of friction greater than that of said conveyor belt surface to cause braking of the loops, thereby promoting inversion of the loops in said zone of deposition on said conveyor belt surface.

* * * * *